US006745600B2

(12) United States Patent
Weiqing et al.

(10) Patent No.: US 6,745,600 B2
(45) Date of Patent: Jun. 8, 2004

(54) WEFT KNITTED BLANKET FABRIC AND METHOD OF MANUFACTURING THE SAME

(75) Inventors: Sun Weiqing, Jiangsu (CN); Xia Weijun, Jiangsu (CN); Qing Jianguo, Jiangsu (CN); Lu Mingqing, Jiangsu (CN)

(73) Assignee: Harbor Healthcare, Inc., Gibbsboro, NJ (US)

( * ) Notice: Subject to any disclaimer, the term of this patent is extended or adjusted under 35 U.S.C. 154(b) by 0 days.

(21) Appl. No.: 10/293,707

(22) Filed: Nov. 13, 2002

(65) Prior Publication Data

US 2004/0089028 A1 May 13, 2004

(51) Int. Cl.[7] ..... D04B 11/08; D04B 23/08; D04B 7/12; D04B 9/12

(52) U.S. Cl. ..... 66/194

(58) Field of Search ..... 66/8, 93, 61, 92, 66/123, 91, 194, 202, 195

(56) References Cited

U.S. PATENT DOCUMENTS

| | | | | | |
|---|---|---|---|---|---|
| 3,152,381 | A | * | 10/1964 | Priester, Jr. et al. | 28/162 |
| 3,434,306 | A | | 3/1969 | Auville et al. | |
| 3,517,530 | A | | 6/1970 | Magnus | |
| 3,785,178 | A | | 1/1974 | Machacek et al. | |
| 4,193,137 | A | | 3/1980 | Heck | |
| 4,199,633 | A | | 4/1980 | Blore | |
| 4,298,643 | A | | 11/1981 | Miyagawa et al. | |
| 4,306,429 | A | | 12/1981 | Warsop | |
| 4,537,048 | A | * | 8/1985 | Gutschmit et al. | 66/93 |
| 4,567,075 | A | * | 1/1986 | Krawczyk | 66/194 |
| 4,667,490 | A | | 5/1987 | Patel | |
| 4,724,179 | A | | 2/1988 | Schnegg | |
| 4,805,424 | A | | 2/1989 | Charkovsky et al. | |
| 4,845,960 | A | | 7/1989 | Schnegg | |
| 4,986,090 | A | * | 1/1991 | Lombardi | 66/9 R |
| 5,186,025 | A | * | 2/1993 | Neher | 66/9 R |
| 5,209,084 | A | | 5/1993 | Robinson et al. | |
| 5,358,198 | A | | 10/1994 | Lesley | |
| 5,422,153 | A | | 6/1995 | Miyamoto | |
| 5,732,573 | A | | 3/1998 | Sexton | |
| 5,735,145 | A | | 4/1998 | Pernick | |
| 5,855,125 | A | * | 1/1999 | Lohmueller et al. | 66/196 |
| 6,131,419 | A | * | 10/2000 | Rock et al. | 66/194 |
| 6,196,032 | B1 | | 3/2001 | Rock et al. | |

* cited by examiner

*Primary Examiner*—Danny Worrell
(74) *Attorney, Agent, or Firm*—Akin Gump Strauss Hauer & Feld, LLP

(57) ABSTRACT

A blanket fabric comprises a weft knitted support substrate and an overfed looped yam weft knitted into the substrate. A portion of the loops are pulled from the face side of the substrate to the opposite side and mechanically loosened to an exceptional degree. Each side of the blanket is sheared to provide even surfaces. The blanket fabric is preferably made with only two weft knitted yarns. The method of making the blanket comprises the steps of simultaneous weft knitting a support substrate and an overfed looped weft knitted yam into the substrate. A portion of the loops are then pulled from the face side of the substrate to the opposite side and mechanically loosened. Both sides of the fabric are then sheared to provide an even surface on each side.

23 Claims, 1 Drawing Sheet

WEFT KNITTED BLANKET FABRIC AND METHOD OF MANUFACTURING THE SAME

BACKGROUND OF THE INVENTION

There is a need for a blanket fabric that is lightweight, has a good hand and feel on both surfaces, provides good warmth, has enhanced tensile strength, and is relatively inexpensive to manufacture. Such a blanket is particularly useful for hospitality and institutional purposes such as hotels, cruise ships, hospitals and care giving institutions. One approach to resolution of the problem is the blanket fabric described in U.S. Pat. No. 4,567,075 issued Jan. 28, 1986 for a "Double Faced Knit Fabric and Method." This patent describes a knit blanket fabric of three bar construction which retains its stability both in the longitudinal direction and the transverse direction, and is nappable on both surfaces without appreciably affecting the substrate. Although knitted, the characteristics of the fabric are said to be at least equal and even superior to those of quality woven blankets. More particularly, the patent describes a double faced knit fabric to be used particularly as a bedding blanket. The fabric is made of at least three bar construction and comprises a support substrate of warp-knit yams, a first facing of warp-knit, overfed looped and napped yams knit into the support substrate, and an opposite facing of warp-knit napped floats of yams. The yams of the opposite facing are warp-knit into the support substrate at the ends of the floats, and at least a portion of the fibers of the opposite facing are left intact and unbroken to provide lateral stability to the fabric. The fibers of the substrate are left substantially intact and unbroken to provide longitudinal stability to the fabric.

Commercial versions of blankets having the structure of the fabric described in U.S. Pat. No. 4,567,075 have been marketed by the owner of the patent, Fab Industries, Inc. However, there remains a need for a blanket structure that has all the features described above, better tensile strength, and which can be marketed at a competitive price. The blanket fabric of the present invention fulfills those criteria.

BRIEF SUMMARY OF THE INVENTION

The present invention relates to a blanket fabric that is light in weight, has good hand and feel on both surfaces, provides good warmth, has good tensile strength, and can be manufactured for sale at a competitive price to the hospitality and institutional industries. The blanket fabric of the present invention comprises a weft knitted support substrate into which an overfed loop yam is weft knitted. A portion of the loops are pulled from the face side of the substrate to the opposite side and mechanically broken. Each side of the blanket is sheared to provide an even surface. In a preferred embodiment of the invention, only two yams are used and about forty to forty-five percent (40%–45%) of the loops are pulled from the face side of the fabric to the opposite side. The pulled loops are mechanically broken by brushing them, and in particular they are exceptionally loosened.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
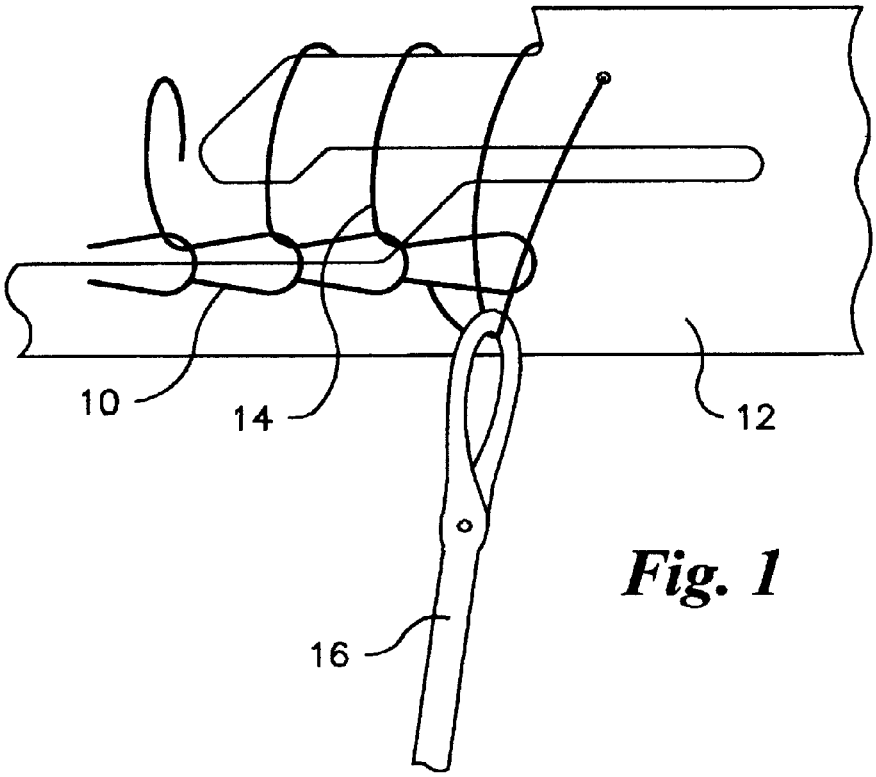
FIG. 1 is a schematic illustration of the two yam knitting operation by which the blanket fabric is manufactured.
Figure 2:
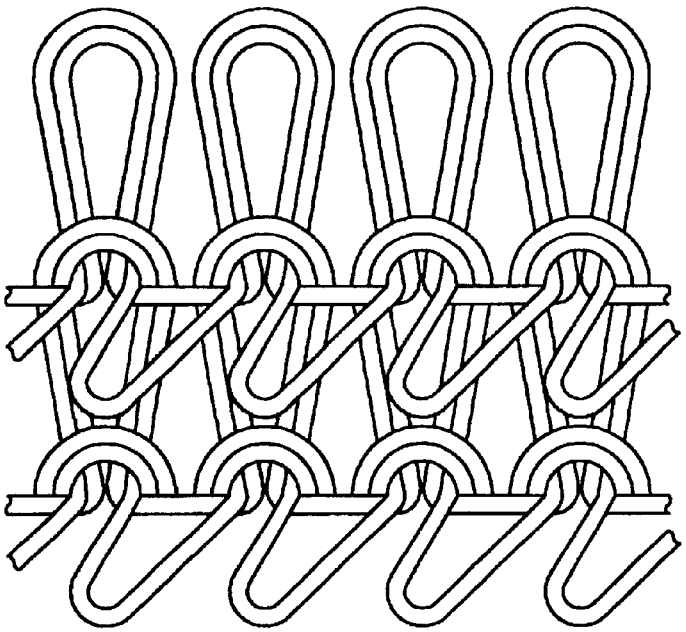
FIG. 2 is a stitch illustration of the combined loop facing and the substrate.

Referring now to the drawings in detail, there is shown in FIG. 1 a schematic illustration of the yarn and needle by which the blanket fabric of the present invention is manufactured. The blanket is knitted by a two bar knitting process. As shown, the yam 10 is weft-knitted on the bar 12 to form the substrate of the blanket fabric. Simultaneously, the yarn 14 is weft-knitted into the substrate by the needle 16. As shown, the yarn 14 is knitted into the substrate as an overfed, looped yarn. Yam 10 is preferably a larger thickness yarn than yarn 14. For example, yarn 10 is preferably 150D and yarn 14 is 96F. Typically, both yams are of a type usually used in the manufacture of blanket fabric such as polyester.

After knitting the fabric as described, a portion of the loops of the thinner yarn 14 are then pulled through the substrate from the face side to the opposite side. This is accomplished using a machine that performs this function. The machine is commercially available from China under the brand name Haining. Preferably, about forty percent (40%) of the loops are pulled through the substrate from the face side to the opposite side. It should be understood that the percentage of loops pulled through the substrate can be varied within a range as desired such as from about forty percent (40%) to about forty-five percent (45%).

After the yarn is pulled through, the loops on the opposite side are extensively brushed. This breaks the loops, especially the loops of a thinner yam such as the preferred 96F yarn. The brushing can be performed by a machine commercially available in China for this purpose.

Once the loops on the opposite side are sufficiently brushed to the point where they are exceptionally broken, both sides of the blanket fabric are sheared to provide an even surface on both the face side of the fabric and the opposite side. Conventional surface shearing machinery for accomplishing this purpose as is known in the art can be used for this purpose.

A blanket can then be constructed from the fabric described herein by providing hems and otherwise finishing the blanket as is known in the art.

To summarize, the steps of making the blanket fabric include weft-knitting a support substrate using the yarn 10 while simultaneously weft-knitting an overfed loop yarn into the substrate, a two bar knitting process. Next, a portion of the loops are pulled from the face side of the substrate to the opposite side and mechanically broken, preferably by brushing the loops but other processes as are known in the art can be used. The final step in the manufacture of the blanket fabric involves shearing each side of the blanket to provide an even surface. In a preferred application of the process, forty percent (40%) of the loops are pulled from the face side of the fabric to the opposite side and the pulled loops are mechanically loosened by brushing them. Moreover, the loops are exceptionally broken during the brushing step. The result is a blanket having good tensile strength. Specifically, a blanket made in accordance with the preferred method exhibits a bursting strength of 156.5 lbs. (average of ten tests). More specifically, the test was conducted in accordance with ASTM D3786 for hydraulic bursting strength of knitted goods and non-woven fabrics on a diaphragm bursting strength tester.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A blanket fabric comprising:

a weft knitted support substrate;

an overfed loop yarn weft knitted into the substrate;

a portion of said loops being pulled from the face side of the substrate to the opposite side and mechanically broken; and each side of the blanket being sheared to provide an even surface.

2. A blanket fabric comprising:

a weft knitted support substrate;

an overfed loop yarn weft knitted into the substrate;

a portion of said loops being pulled from the face side of the substrate to the opposite side and mechanically broken; and each side of the blanket being sheared to provide an even surface, wherein about forty percent (40%) to about forty-five percent (45%) of the loops are pulled from the face side of the fabric to the opposite side.

3. The blanket fabric in accordance with claim 1 wherein the pulled loops are mechanically broken by brushing them.

4. The blanket fabric in accordance with claim 2 wherein the pulled loops are mechanically broken by brushing them.

5. The blanket fabric in accordance with claim 1 wherein the fabric is made with only two weft knitted yarns.

6. A method of making a blanket fabric comprising the steps of:

weft knitting a support substrate;

weft knitting an overfed looped yarn into the substrate;

pulling a portion of the loops from the face side of the substrate to the opposite side;

mechanically breaking the pulled loops; and shearing each side of the fabric to provide an even surface on each side.

7. A method of making a blanket fabric in accordance with claim 6 wherein the substrate and the overfed loop knitted yarn are simultaneously knitted.

8. A method of making a blanket fabric comprising the steps of:

weft knitting a support substrate;

weft knitting an overfed looped yarn into the substrate;

pulling a portion of the loops from the face side of the substrate to the opposite side;

mechanically breaking the pulled loops; and shearing each side of the fabric to provide an even surface on each side, wherein about forty percent (40%) to about forty-five percent (45%) of the loops are pulled from the face side of the substrate to the opposite side.

9. A method of making a blanket fabric in accordance with claim 6 wherein the pulled loops are mechanically broken by brushing them.

10. A method of making a blanket fabric in accordance with claim 7 wherein the pulled loops are mechanically broken by brushing them.

11. A method of making a blanket fabric wherein the fabric is made with only the two weft knitted yarns.

12. A method of making a blanket fabric in accordance with claim 6 wherein the pulled loops are exceptionally broken.

13. A blanket fabric comprising only two knitted yarns, said fabric including:

a weft knitted support substrate;

an overfed loop yarn simultaneously knitted into the substrate;

a portion of said loops being pulled from the face side of the substrate to the opposite side and mechanically broken to an exceptional degree; and each side of the blanket being sheared to provide an even surface.

14. A blanket fabric comprising only two knitted yarns, said fabric including:

a weft knitted support substrate;

an overfed loop yarn simultaneously knitted into the substrate;

a portion of said loops being pulled from the face side of the substrate to the opposite side and mechanically broken to an exceptional degree; and each side of the blanket being sheared to provide an even surface, wherein about forty percent (40%) to about forty-five percent (45%) of the loops are pulled from the face side of the fabric to the opposite side.

15. The blanket fabric in accordance with claim 13 wherein the pulled loops are mechanically loosened by breaking them.

16. A fabric comprising:

a weft knitted support substrate;

an overfed loop yarn weft knitted into the substrate;

a portion of said loops being pulled from the face side of the substrate to the opposite side and mechanically broken; and each side of the fabric being sheared to provide an even surface.

17. The fabric in accordance with claim 16, wherein about forty percent (40%) to about forty-five percent (45%) of the loops are pulled from the face side of the fabric to the opposite side.

18. The fabric in accordance with claim 16 wherein the pulled loops are mechanically broken by brushing them.

19. The fabric in accordance with claim 17 wherein the pulled loops are mechanically broken by brushing them.

20. The fabric in accordance with claim 16 wherein the fabric is made with only two weft knitted yams.

21. A fabric comprising only two knitted yarns, said fabric including:

a weft knitted support substrate;

an overfed loop yarn simultaneously knitted into the substrate;

a portion of said loops being pulled from the face side of the substrate to the opposite side and mechanically broken to an exceptional degree; and each side of the fabric being sheared to provide an even surface.

22. The fabric in accordance with claim 21 wherein about forty percent (40%) to about forty-five percent (45%) of the loops are pulled from the face side of the fabric to the opposite side.

23. The fabric in accordance with claim 21 wherein the pulled loops are mechanically loosened by breaking them.

* * * * *